United States Patent [19]

Johansson

[11] 4,167,072

[45] Sep. 11, 1979

[54] BOOM ARRANGEMENT FOR DRAGLINE

[75] Inventor: John R. Johansson, Västra Frölunda, Sweden

[73] Assignee: Gravmaskinsbolaget John Johansson AB, Västra Frölunda, Sweden

[21] Appl. No.: 774,189

[22] Filed: Mar. 3, 1977

[30] Foreign Application Priority Data

Mar. 3, 1976 [SE] Sweden ..... 7602980

[51] Int. Cl.[2] ..... E02F 3/46

[52] U.S. Cl. ..... 37/116; 37/117.5; 37/135

[58] Field of Search ..... 37/116, 139, 136, 115, 37/117.5; 214/92, 523

[56] References Cited

U.S. PATENT DOCUMENTS

| | | | |
|---|---|---|---|
| 2,133,406 | 10/1938 | Shelton et al. | 37/135 |
| 2,269,917 | 1/1942 | Repplinger | 37/117.5 X |

*Primary Examiner*—Clifford D. Crowder

*Attorney, Agent, or Firm*—Harness, Dickey & Pierce

[57] ABSTRACT

An excavating machine comprising a pivotal boom supporting at its outer end a drag bucket with the aid of a first line, and a bucket support arm articulated to the boom and a second line extending from said drag bucket to the outer end of the bucket support arm, whereby the drag bucket may be hauled close to the machine, irrespective of the height variations of the ground.

10 Claims, 4 Drawing Figures

17
18
15
16
14
29
28
9
8
19
11
13
4
33
12
6
7
10
1
5
22
23
20
24
27
2
25
21
26
31
3
32
30

17
15
16
9
29
28
8
4
18
14
13
11
12
6
7
12
19
33
10
1
5
27
27
22
23
24
25
2
20
31
26
3
30
21
32

BOOM ARRANGEMENT FOR DRAGLINE

BACKGROUND OF THE INVENTION

In earth-moving operations with the aid of excavators of the kind equipped with a boom mounted for pivotal movement in a vertical plane on the support of a basic machine, with a bucket support arm pivotally mounted at the outer end of the boom to support at its outer end a digging bucket which is pivotally mounted thereon and detachable from the support arm, and possibly with a rocker arm which is mounted for pivotal movement in a vertical plane and the outer end of which supports a drag bucket with the aid of a line, said drag bucket arranged to be hauled in, with the aid of a second line, towards a winch which is arranged on the basic machine, certain ground conditions and deep excavations quite simply make it impossible to stretch the line leading to the winch. For instance, a heap of earth situated close to the basic machine could impede the hauling-in of the line with the aid of the winch and thus make it impossible to operate the drag bucket correctly.

SUMMARY OF THE INVENTION

The purpose of the present invention is primarily to remedy this drawback. Characteristic of the invention are means which make is possible to haul the drag bucket towards the basic machine with the aid of a second line extending from the drag bucket to the outer end of a pivotable arm, e.g. the bucket support arm from which the digging bucket preferably is removed. By pivoting said arm (the bucket arm) it becomes possible to haul the drag bucket towards the basic machine, irrespective of the inclination of the bucket, and also to hoist the bucket to empty its contents into e.g. a loading vehicle to carry away the excavated material.

In accordance with a preferred embodiment of the invention, a pulling arm is pivotally mounted to the outer end of said pivotable arm (the bucket support arm), said second line running from the outer end of said pulling arm. The provision of a pulling arm thus arranged makes it possible to haul in the drag bucket almost vertically towards the basic machine. To perform the pivoting movements of the pulling arm it is preferred to use the hydraulic piston-and-cylinder unit which is used to effect the pivoting movements of the ordinary digging bucket, the latter normally being removed from the bucket support arm when the drag bucket is used. Consequently, there is no need for installing additional controls on the basic machine. The winch earlier provided inside the basic machine to haul in the drag bucket therefore may be entirely eliminated, for which reason no re-arrangement or reconstruction of the basic machine itself is necessary.

BRIEF DESCRIPTION OF THE DRAWINGS

The invention will be described more in detail in the following with reference to the accompanying, partly diagrammatical drawings, illustrating two excavating machines in accordance with the invention in lateral views while used for excavating work with the aid of a drag bucket. In the drawings.

DETAILED DESCRIPTION OF PREFERRED EMBODIMENTS

Figure 1:
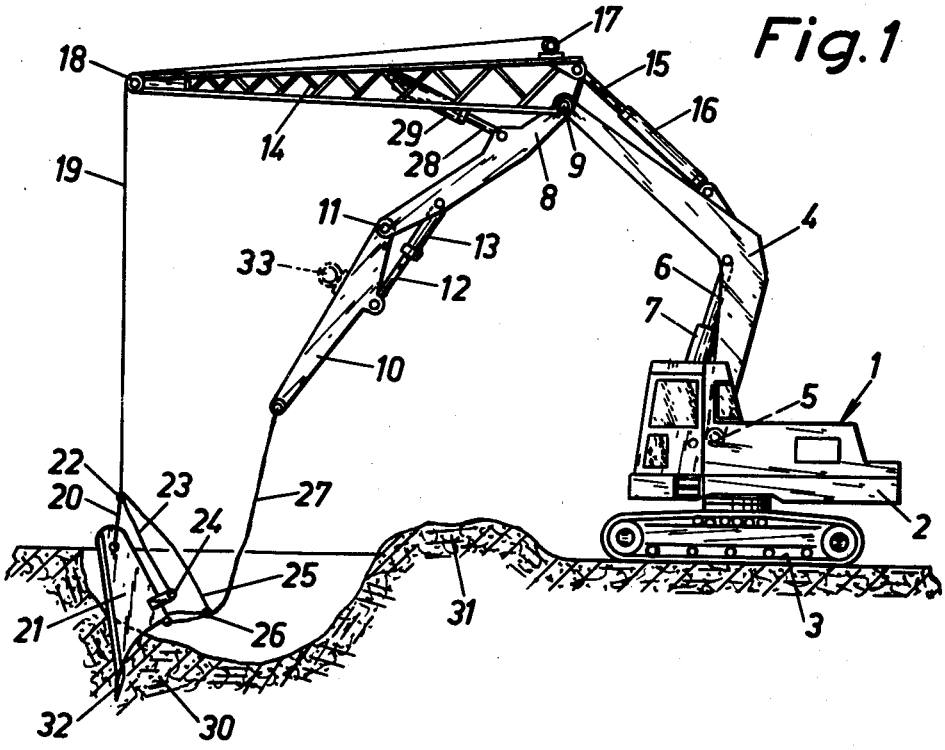
FIG. 1 illustrates the drag bucket in an initial stage of the earth-moving operation.
Figure 2:
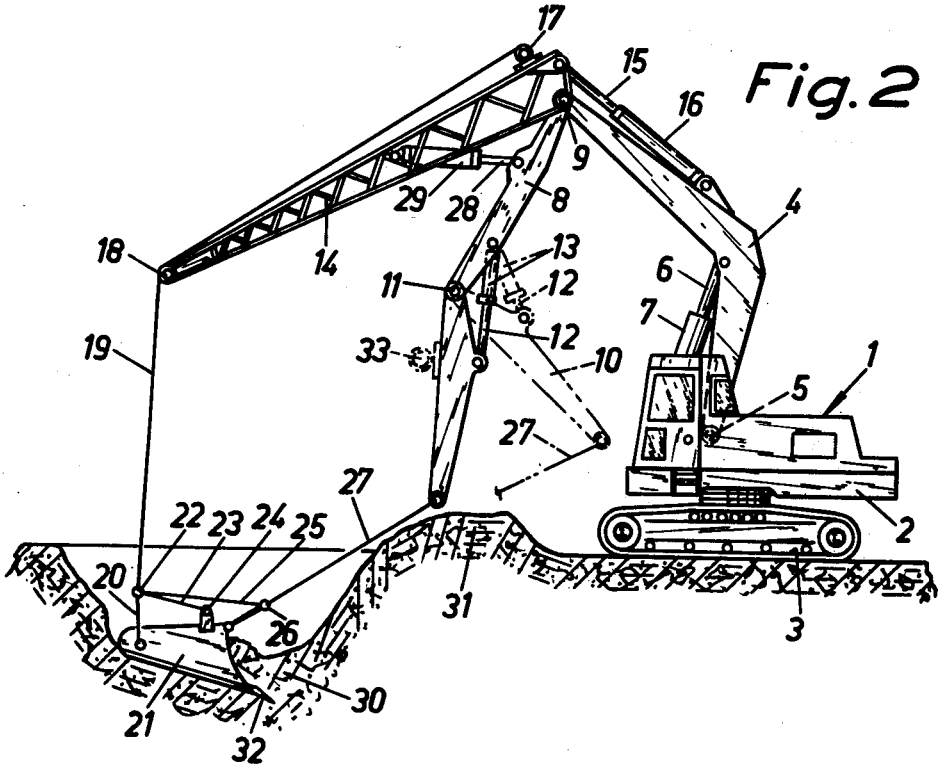
FIG. 2 is an identical view, illustrating a later stage of the earth-moving operation with the aid of an excavating machine in accordance with a first embodiment of the invention.

FIGS. 1 and 2 of the drawings illustrate a hydraulic excavating machine from which the ordinary digging bucket has been removed. The support 2 of the basic machine 1 rests on an endless track 3. An angle boom 4 is pivotally mounted at its one end to a horizontal shaft 5 on the support 2 and may be swung in a vertical plane by means of a hydraulic piston-and-cylinder unit 6, 7. At its outer end, the boom 4 is provided with a bucket support arm 8, one end of which is pivotally mounted on a horizontal shaft 9 on the boom 4. The outer end of the bucket support arm 8 from which the ordinary digging bucket has been removed, supports a pulling arm 10 which is arranged to pivot about a horizontal shaft 11 and may be operated by means of a piston-and-cylinder unit 12, 13, i.e. the piston-and-cylinder unit controlling the movements of the ordinary digging bucket (not shown). The pulling arm 10 and bucket support arm 8 may be considered as support arm means in this embodiment. The boom 4 additionally is provided with a rocker arm 14 one end of which by means of two legs grips on either side of the boom 4 and which is mounted at the outer end of the boom so as to pivot about the shaft 9. The boom 4 and rocker arm 14 may be considered together as a boom means in this embodiment. A piston-and-cylinder unit 15, 16 pivots the rocker arm 14 from e.g. the outer position thereof illustrated in FIG. 1 to the inner position thereof illustrated in FIG. 2. The rocker arm 14 is provided with a preferably hydraulically operated winch 17 controlling a line 19 running over a pulley 18 provided at the outer end of the rocker arm. The line is attached to the upper end of a yoke 20 the lower end of which is articulated to a drag bucket 21. The upper end of the yoke 20 is provided with a pulley 22 over which runs a balancing line 23, one end 24 of which is secured at the top of the forward end of the drag bucket 21 and the opposite end 25 of which merges into a dragline 27 running over a pulley 26. The dragline is secured to the outer end of the pulling arm 10 which is pivotable in a vertical plane with the aid of a hydraulic piston-and-cylinder unit 28, 29 provided between the rocker arm 14 and the pulling arm.

When one wishes to remove the earth section 30 positioned beyond (to the left of) the heap of earth 31, the drag bucket 21 is initially pulled upwards with the aid of the line 19 leading to the winch 17 upwards. The line 19 is then rapidly winched out again, allowing the drag bucket 21, as a result of its own weight, to dig its operative edge 32 into the ground. After setting of the bucket support arm 8 in the desired position with the aid of the piston-and-cylinder unit 28, 29, the pulling arm 10 is swung by the piston-and-cylinder unit 12, 13 in the counter-clockwise direction as seen in the drawings, e.g. to the position shown in FIG. 2 with dash-and-dot lines, while simultaneously the piston-and-cylinder unit 15, 16 pivots the rocker arm 14 downwards. This pulls the drag bucket 21 in the direction towards the basic machine, and at the same time, while being moved, it is filled with ground material. The boom 4 is swung upwards to lift the drag bucket 21 and by turning the support 2 in the horizontal plane, the drag bucket is put in the correct position to empty its contents into a waiting loading truck.

The work is facilitated if the upper end of the line 27 is secured to a winch 33 (indicated in dash-and-dot lines in FIG. 1) provided on the upper face of the pulling arm 10, and serving to haul in the line.

Figure 3:
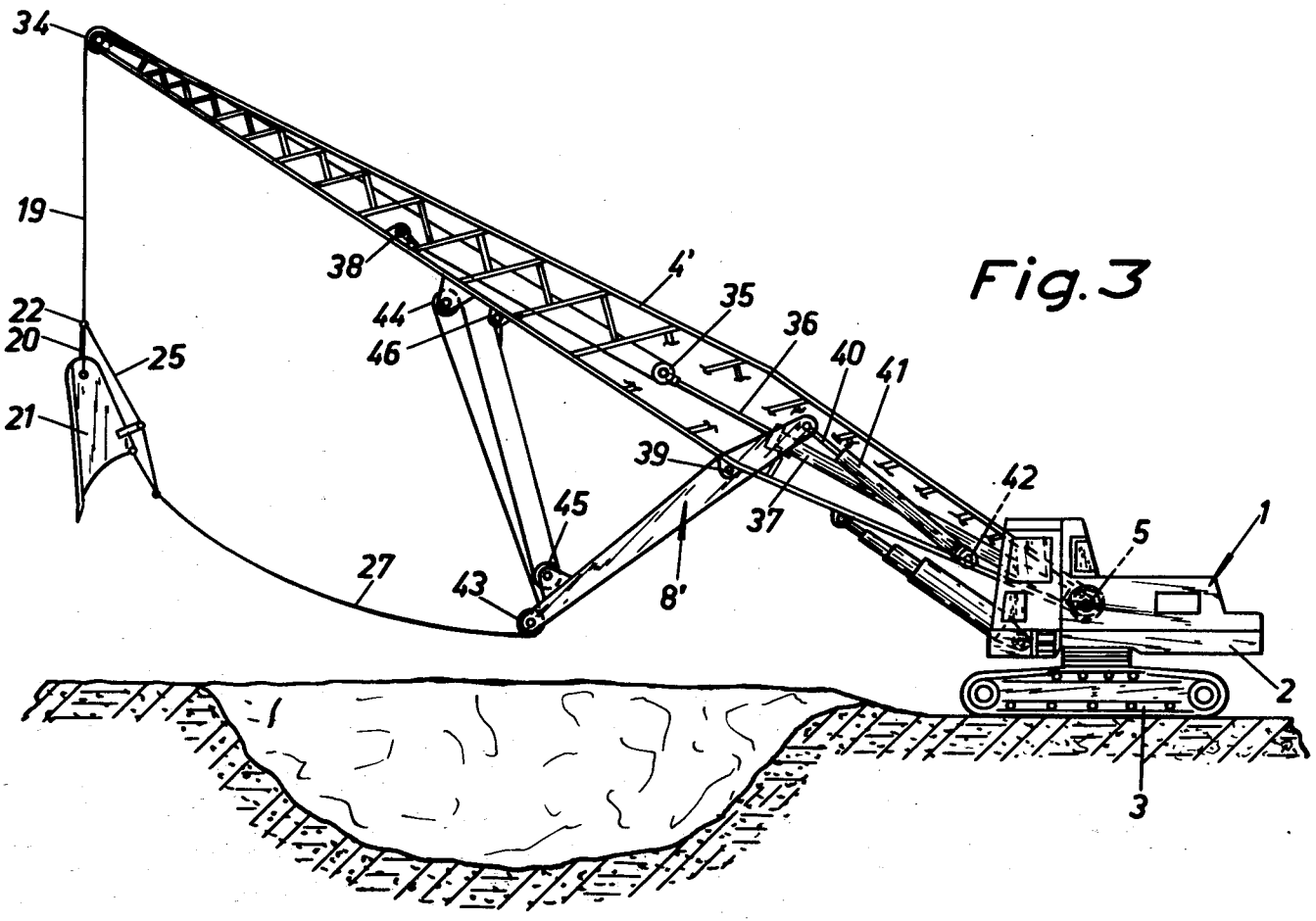
FIGS. 3 and 4 illustrate a simplified embodiment of an excavating machine in accordance with the invention.
Figure 4:
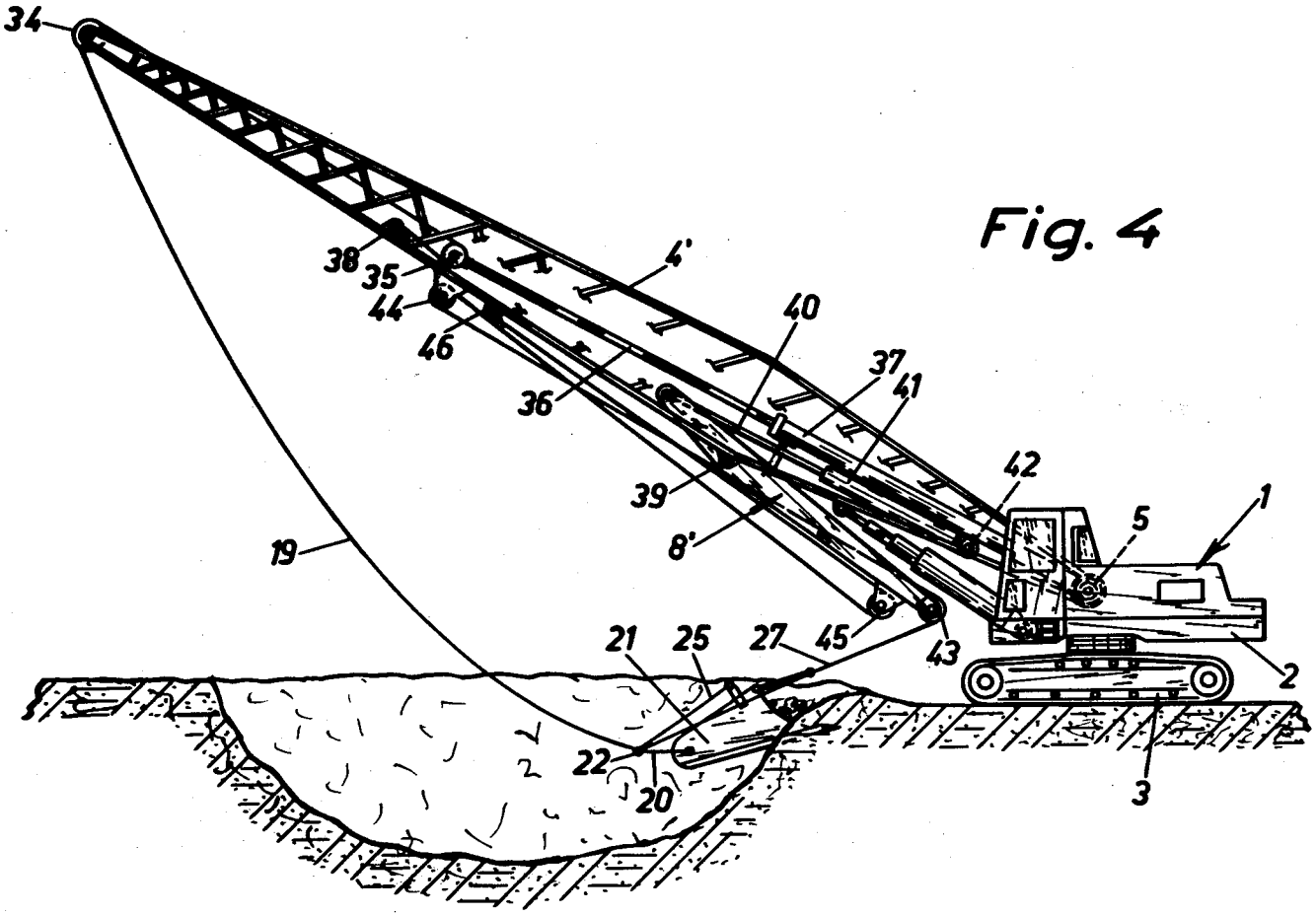

The embodiment illustrated in FIGS. 3 and 4 is structurally more simple than the one shown in FIGS. 1 and 2. In the embodiment of FIGS. 3 and 4, the boom means comprises a boom 4' which is pivotally mounted for swinging movement about the shaft 5 is made in one integral piece (i.e. without the rocker arm 14). The line 19 leading to the rear end of the drag bucket 21 runs over a pulley 34 positioned at the upper end of the boom 4', further over a pulley 35 positioned at the outer end of the piston rod 36 of a piston-and-cylinder unit 37, the lower end of which is secured to the boom adjacent the shaft 5. The opposite end of the line 19 is secured to a fitting 38 on the boom 4'.

The support arm means of this embodiment comprises a bucket arm 8' constructed as a two-arm lever which is journalled so as to pivot about a horizontal shaft 39 on the boom 4'. The upper arm of the bucket support arm 8' is articulated to the upper end of the piston rod 40 of a hydraulic cylinder 41 the lower end of which is articulated to the boom 4' by means of a horizontal shaft 42. The line 27 leading to the front end of the drag bucket 21 runs over a pulley 43 provided at the lower end of the bucket support arm 8', further over a pulley 44 provided on the boom 4' above the articulation shaft 39 of the bucket arm 8', further over a pulley 45 provided adjacent the lower end of the bucket support arm, whereas its opposite end is secured to a fitting 46 on the boom 4' (alternatively the arm 8').

When the drag bucket 21, with the aid of the piston-and-cylinder unit 36, 37 and the line 19, has been brought to the earth-moving starting position, in which position the bucket support arm 8' has been swung outwards to the position illustrated in FIG. 3, the bucket support arm is pivoted counter-clockwise with the aid of the piston-and-cylinder unit 40, 41, e.g. to the position shown in FIG. 4, whereby the line 27 pulls the drag bucket 21 in the direction towards the basic machine 1 owing to the increased distance between the pulleys 44 and 45 following the pivotal movement of the bucket support arm 8' and, as a consequence thereof, hauling-in of the line 27. A separate pulling arm 10, like the one shown in FIGS. 1 and 2, in this case therefore is not considered necessary.

When a basic machine 1, equipped with the boom 4, the bucket support arm 8 and a digging bucket pivotally mounted at the outer end of the arm, is to be converted into an excavator utilizing a drag bucket 21, the boom 4, the bucket support arm 8 and the digging bucket are replaced by the boom 4', designed as an integral unit, the bucket support arm 8' and the drag bucket 21 together with the associated lines 19, 27, whereupon the boom is journalled to the frame 2 of the basic machine 1 by means of the shaft 5.

The embodiments as shown and described are to be regarded as examples only and the various parts of the excavating machine, particularly the rocker arm 14 and the pulling arm 10 may be structurally altered in a variety of ways within the scope of the invention. The hydraulic piston-and-cylinder unit 12, 13 controlling the pulling arm 10 may be disposed between the boom 4 and the pulling arm.

What I claim is:

1. An improvement in excavating machines comprising a basic machine, a machine support, boom means mounted on said support for pivotal movement in a vertical plane, a drag bucket supported at the outer end of said boom means by means of a line, and a support arm means pivotally mounted on said boom means, the improvement comprising a second line extending from said drag bucket to the outer end of said support arm means to pull said drag bucket in the direction towards said basic machine.

2. An improved excavating machine as claimed in claim 1, wherein the support arm means comprises two pivotally connected arms comprising a pulling arm pivotally mounted on the outer end of a first arm, the inner end of said first arm being pivotally mounted on said boom means said second line to said drag bucket departing from the outer end of said pulling arm.

3. An improved excavating machine as claimed in claim 2, wherein the boom means is in the form of a boom pivotally mounted on the support and a rocker arm, said rocker arm arranged for pivotal movement at its inner end in a vertical plane at the outer end of said boom, said first line to said drag bucket departing from the outer end of said rocker arm.

4. An improved excavating machine as claimed in claim 2, comprising a hauling means provided on said pulling arm to haul in said second line, said second line secured to the front end of said drag bucket.

5. An improved excavating machine as claimed in claim 1, wherein the boom means is in the form of a boom pivotally mounted on the support and a rocker arm, said rocker arm arranged for pivotal movement at its inner end in a vertical plane at the outer end of said boom, said first line to said drag bucket departing from the outer end of said rocker arm.

6. An improved excavating machine as claimed in claim 5, comprising a hydraulic piston-and-cylinder unit mounted between said first support arm means and said rocker arm.

7. An improved excavating machine as claimed in claim 5, wherein said rocker arm is pivotally mounted about a horizontal pivot shaft, said bucket support arm means being pivotally mounted on the outer end of said boom by said horizontal pivot shaft.

8. An improved excavating machine as claimed in claim 5, comprising a hauling means provided on said rocker arm to haul in said first line, said first line secured to the rear end of said drag bucket.

9. An improved excavating machine as claimed in claim 5, comprising a first pulley on the outer end of said support arm means, and a second pulley on said boom means, said second line running over said first pulley from said drag bucket and then further over said second pulley, the opposite end of said line secured to said boom means.

10. An improved excavating machine as claimed in claim 1, comprising a hydraulic piston-and-cylinder unit mounted between said support arm means and said boom means.

* * * * *